US008790227B2

(12) United States Patent
Meister et al.

(10) Patent No.: US 8,790,227 B2
(45) Date of Patent: Jul. 29, 2014

(54) EXERCISE APPARATUS AND METHODS

(75) Inventors: Gregory N. Meister, Foster City, CA (US); Charles B. Perez, Jr., Winetka, CA (US)

(73) Assignee: Meister Management, Inc., Foster City, CA (US)

( * ) Notice: Subject to any disclaimer, the term of this patent is extended or adjusted under 35 U.S.C. 154(b) by 176 days.

(21) Appl. No.: 13/422,900

(22) Filed: Mar. 16, 2012

(65) Prior Publication Data

US 2012/0316041 A1 Dec. 13, 2012

Related U.S. Application Data

(60) Provisional application No. 61/495,822, filed on Jun. 10, 2011.

(30) Foreign Application Priority Data

Jul. 12, 2011 (TW) ..... 100212735
Jul. 14, 2011 (CN) ..... 2011 2 0248131

(51) Int. Cl.
*A63B 26/00* (2006.01)

(52) U.S. Cl.
USPC ..... 482/140; 482/141

(58) Field of Classification Search
USPC ..... 482/44–49, 79, 92, 121–130, 148, 905, 482/140–142
See application file for complete search history.

(56) References Cited

U.S. PATENT DOCUMENTS

| | | | | |
|---|---|---|---|---|
| 5,224,914 | A | 7/1993 | Friedman | |
| 5,507,712 | A | 4/1996 | Chang | |
| 5,746,688 | A * | 5/1998 | Prager | 482/142 |
| 5,772,563 | A | 6/1998 | Lin | |
| 5,964,685 | A | 10/1999 | Boland | |
| 6,056,676 | A | 5/2000 | Adams | |
| 6,090,023 | A * | 7/2000 | Liu | 482/140 |
| 6,117,057 | A | 9/2000 | Olschansky et al. | |
| 6,592,500 | B1 | 7/2003 | McBride et al. | |
| 6,743,159 | B1 | 6/2004 | Taylor et al. | |
| 7,137,934 | B2 | 11/2006 | Paramater | |
| 7,341,547 | B2 * | 3/2008 | Liao | 482/140 |
| 8,002,683 | B1 | 8/2011 | Nayebdadash | |
| 2007/0027008 | A1 | 2/2007 | Levinson et al. | |
| 2007/0298945 | A1 | 12/2007 | Mehta | |

* cited by examiner

*Primary Examiner* — Loan H Thanh
*Assistant Examiner* — Megan Anderson
(74) *Attorney, Agent, or Firm* — Gary L. Loomis; G. L. Loomis & Assoc., Inc.

(57) ABSTRACT

An exercise apparatus includes a U-bar the ends of which are pivotally coupled to two L-bars by rotatable hinge assemblies containing a torsion spring. The rotatable hinge assemblies have a torsion spring tension setting means configured to vary the tension of the torsion spring and to secure the torsion spring at two or more distinct tensions settings without disassembly of the apparatus thus providing two or more distinct levels of resistance to the relative rotation of each L-bar independently with respect to the U-bar. Additionally, in certain embodiments of the apparatus each hinge assembly has an operation setting means that functions to control the allowable independent rotation of each L-bar relative to the U-bar end sections.

11 Claims, 18 Drawing Sheets

EXERCISE APPARATUS AND METHODS

RELATED APPLICATION DATA

This application claims priority under 35 U.S.C. §119 to U.S. Provisional Application Ser. No. 61/495,822 filed Jun. 10, 2011; Taiwan Application No. 100212735 filed Jul. 12, 2011; and China Application No. 201120248131.3 filed Jul. 14, 2011; all of which are herein included by way of reference in their entirety.

FIELD OF THE INVENTION

The present invention relates to an exercise apparatus, and more particularly to an abdominal muscle exercise apparatus with adjustable resistance.

BACKGROUND

Abdominal exercise devices are known in the art. For example, U.S. patent application publication 2007/0027008 of Levinson et al. describes an abdominal exercise device including an upper abdominal lever member a lower abdominal lever member connected by with spring-biased resistance hubs, wherein operation of the lever members when rotated about the resistance hubs provides a scissor-like movement of respective upper and lower lever members connected to the resistance hub. However, such devices are very limited in the variety of exercises it permits, since the lever members are singular members. Also, while Levinson does allude to interchangeable resistance hubs pairs of varying resistance or tension, the apparatus must be disassembled and reassembled to effect each change of hubs and does not allow for a facile change of resistance during an exercise routine. Additionally, in such an apparatus the components required to change tension can be easily lost or misplaced.

In another example U.S. Pat. No. 6,080,090 to Taylor et al. describes a folding portable exercise apparatus having a single padded U-bar and a single padded lap bar, wherein two pairs of length-adjustable telescoping rods connect the bars and each pair of telescoping rods is joined by a coil spring. While U.S. Pat. No. 7,341,547 to Liao describes an exercise apparatus having a base, a head member, two first mounting members, and two handles. The base includes a main portion, and two arm portions extending from opposite ends of the main portion. Such apparatuses are very limited in that they each fail to provide a means for a user to conveniently vary resistance and each design permits only limited exercise options.

Therefore, the abdominal fitness devices known in the art have the following drawbacks that and required improvements.

Since the resistance of such devices is fixed or not easily adjustable without disassembly, a user cannot make appropriate rapid adjustments of resistance during a training routine or for different training regimes. Furthermore, the devices having a single thigh leaning bar are designed for a user to lift both legs simultaneously thereby limiting the variety of exercises that can be performed.

Therefore, a need exists for an abdominal fitness apparatus that allows users to make rapid adjustments to enable a variety of training modes. A further need exists for a portable apparatus that provides easily adjustable resistance without disassembly, such that users may rapidly and easily vary resistance during a training regime. A still further need exists for an apparatus that permits exercising each leg individually as well each side of the abdominal area individually.

The present invention address these as well as other needs.

SUMMARY OF THE INVENTION

A typical exercise apparatus of the present invention comprises a U-bar having a first U-bar end section comprising a first U-bar hinge component having a first U-bar hinge component internal surface and a first U-bar hinge component external surface, a second U-bar end section comprising a second U-bar hinge component having a second U-bar hinge component internal surface and a second U-bar hinge component external surface, wherein each U-bar hinge component is configured to define a U-bar hinge component pivot pin hole extending there through, and a U-bar median section wherein the first U-bar end section, the second U-bar end section and the U-bar median section are essentially coplanar and wherein each U-bar end section is perpendicular to the U-bar median section. The apparatus further comprises two mirror-imaged L-bars each having an L-bar proximal section and an L-bar distal section, wherein the end of each L-bar proximal section comprises an L-bar hinge component having an L-bar hinge component internal surface and an L-bar hinge component external surface, wherein each L-bar hinge component internal surface is mated to one of the corresponding U-bar hinge component internal surfaces and wherein each L-bar hinge component is configured to define an L-bar hinge component pivot pin hole extending there through. A pivot pin extends through each of the U-bar pivot pin holes and each of the corresponding L-bar pivot pin holes to provide a first rotatable hinge assembly and a second rotatable hinge assembly such that each L-bar is independently rotatable with respect to the U-bar and wherein each L-bar proximal section rotates in a plane parallel to the plane of the first and second U-bar sections. Each rotatable hinge assembly further comprises a torsion spring and a torsion spring tension setting means configured to vary tension of the torsion spring and to secure the torsion spring at two or more distinct tensions settings without disassembly of the apparatus thus providing two or more distinct desired levels of resistance to the relative rotation of each L-bar independently with respect to the U-bar. Furthermore, such a tension setting means allows for the quick and easy variation the resistance to rotation of each L-bar according to the requirements of the user.

In certain preferred embodiments each torsion spring comprises a torsion spring first hook-shaped end and a torsion spring second hook-shaped end, wherein approximately half of the body of the torsion spring comprising the first hook-shaped end is disposed within an L-bar hinge component torsion spring embedding groove that extends into the L-bar hinge component internal surface and which is circumferentially disposed about the pivot pin hole and wherein the torsion spring second hook-shaped end is embedded and retained in an L-bar hinge component torsion spring retainer notch that extends into the L-bar hinge component internal surface and which is contiguous with the L-bar hinge component torsion spring embedding groove. While the approximately half of the body of the torsion spring comprising the second hook-shaped end is disposed within a U-bar hinge component embedding groove circumferentially disposed about the pivot pin hole extending into the mating U-bar hinge component internal surface and extending towards the periphery of the U-bar hinge component, wherein the U-bar hinge component embedding grove is configured to defines a U-bar hinge component embedding groove rim overhanging the U-bar hinge component embedding groove around the entire circumference. The torsion spring second hook-shaped end is disposed through a torsion spring hook access notch that extends into the U-bar hinge component internal surface and which is contiguous with the U-bar hinge component embedding groove. In such embodiments the torsion spring tension setting means comprises a tension adjustment knob springedly coupled to, and rotatable about, the pivot pin distal end, wherein the tension adjustment knob comprises a tension adjustment knob pin disposed parallel to the axis of the pivot pin. The first and second U-bar hinge components are each configured to define two or more adjustment knob pin holes extending though the U-bar hinge components embedding grooves parallel to the longitudinal axis of, and arranged circumferentially about, the pivot pin and dimensioned to accept tension the adjustment knob pin to be extended there through; wherein such an arrangement enables rotation of the tension adjustment knob as well movement of the tension adjustment knob along the pivot pin longitudinal axis to enable insertion of the adjustment knob pin into a selected one of the two or more adjustment knob pin holes, so that the adjustment knob pin engages the torsion spring second hook-shaped end, thereby setting the level of resistance to the relative rotation of each L-bar independently with respect to the U-bar.

In certain preferred embodiments each hinge assembly is provided with an operation setting means that functions to control the allowable independent rotation of each L-bar relative to the first and second U-bar sections. In certain preferred embodiments the operation setting means comprise an operation setting pin having a proximal end and a distal end and an operation setting pin knob attached to the operation setting pin proximal end, wherein the operation setting pin is disposed within an operation setting pin hole extending through each U-bar hinge component parallel to the longitudinal axis of the pivot pin, and wherein the internal surface of each mating L-bar hinge component is configured to define an operation setting pin hole and an arc shaped operation setting pin slot positioned circumferentially about the pivot pin hole and proximate to the operation setting second pin hole; wherein both the operation setting pin holes and the arc shaped operation setting pin slots are dimensioned to accommodate the distal end of the operation setting pin. In certain of such embodiments the degree of arc is about 90°.

In certain other preferred embodiments each L-bar is also provided with a cylindrical roller circumferentially disposed about the L-bar distal section near the distal ends of the L-bar. Such a roller is freely rotatable about the L-bar distal section and functions to cushion the contact between the apparatus and the thighs or other body parts of the user. In certain preferred embodiments the rollers comprise a soft resilient material such as rubber, foam rubber, soft plastic, textile or other suitable material.

In a typical application a user assumes a starting position by sitting in a chair or on a bench and leaning the chest against the median section of the U-bar while the thighs contact the cylindrical rollers of the L-bars. The user then applies downward pressure with the chest to overcome the resistance of the torsion spring and rotate the U-bar median section toward the thighs to exercise the hip flexors and the lower abdominal muscles. Alternatively, a user can assume the same a starting position and then lift the thigh to overcome the resistance of the torsion spring and rotate the U-bar median section towards the chest to perform the thigh muscle training. Such a thigh training exercise can be performed by moving each thigh alternately or in unison. Furthermore, a different resistance level can be set for each thigh.

DESCRIPTION OF THE INVENTION

Figure 1:
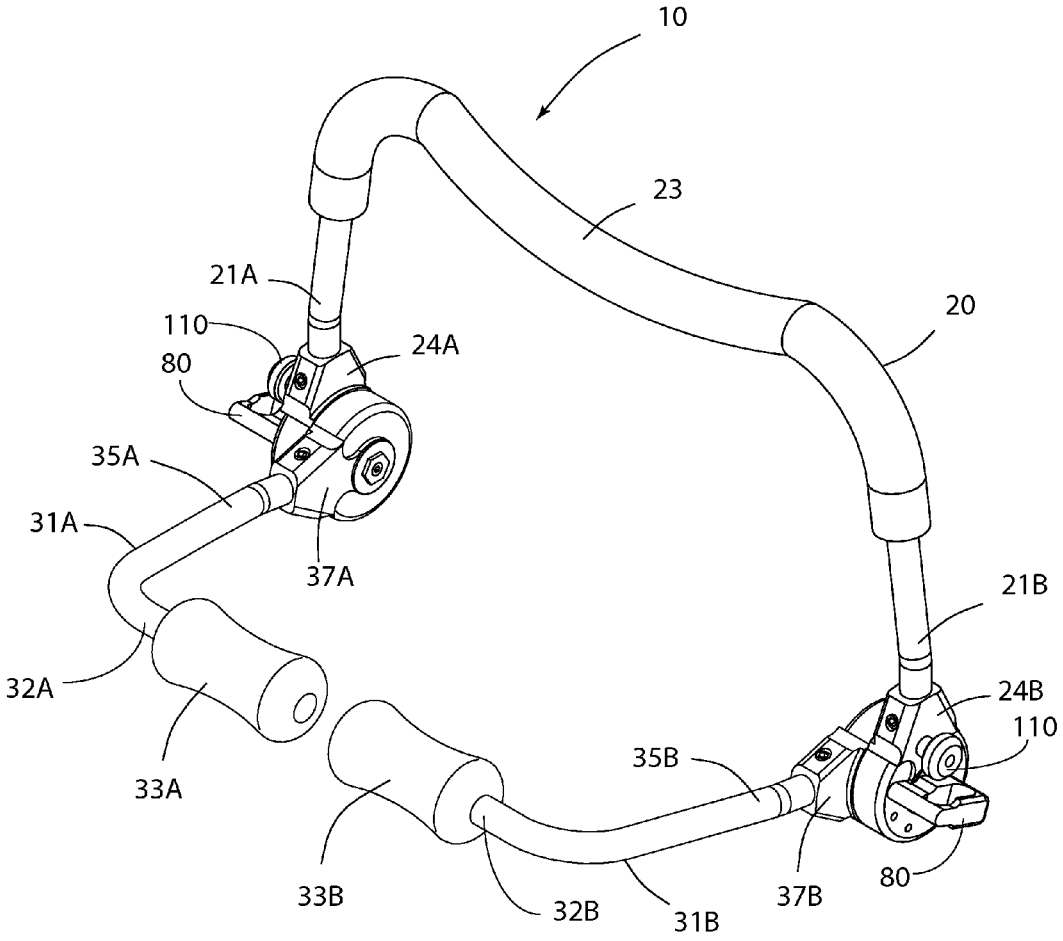
FIG. 1 is a perspective view of an embodiment of an exercise apparatus of the invention.
Figure 2:
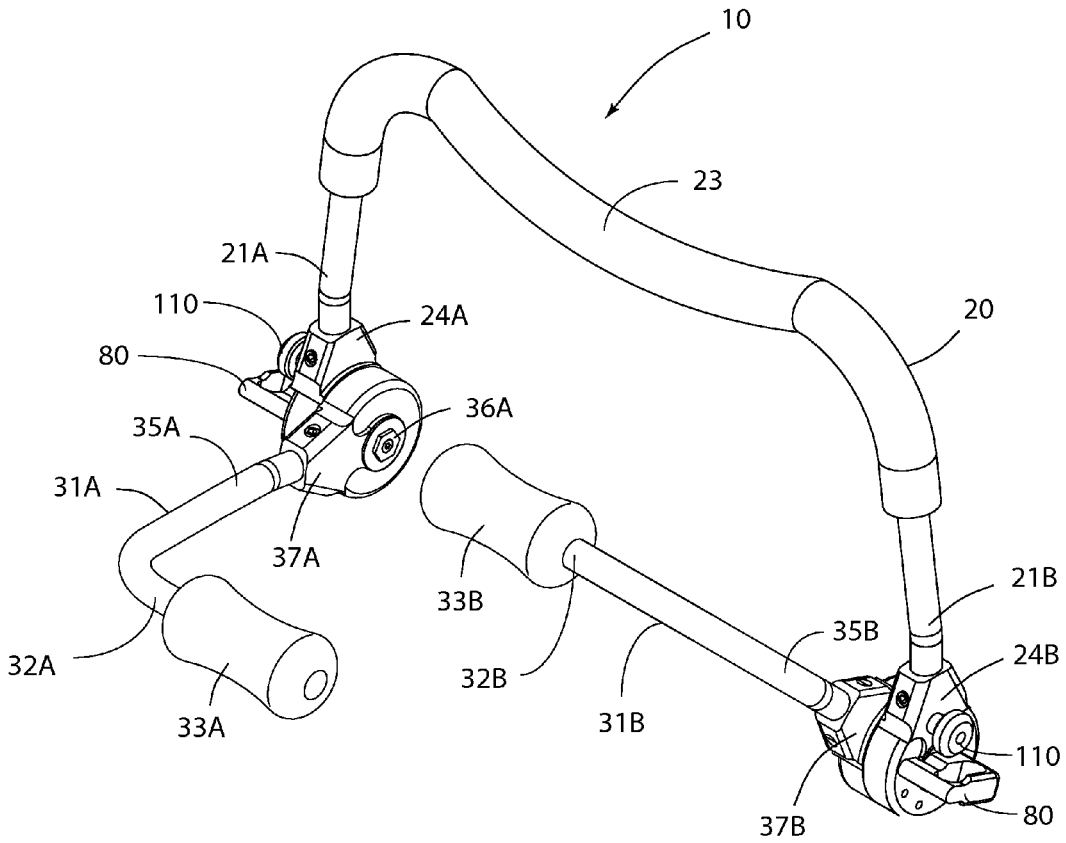
FIG. 2 is a perspective view of the apparatus illustrated in FIG. 1 shown in a different configuration.
Figure 3:
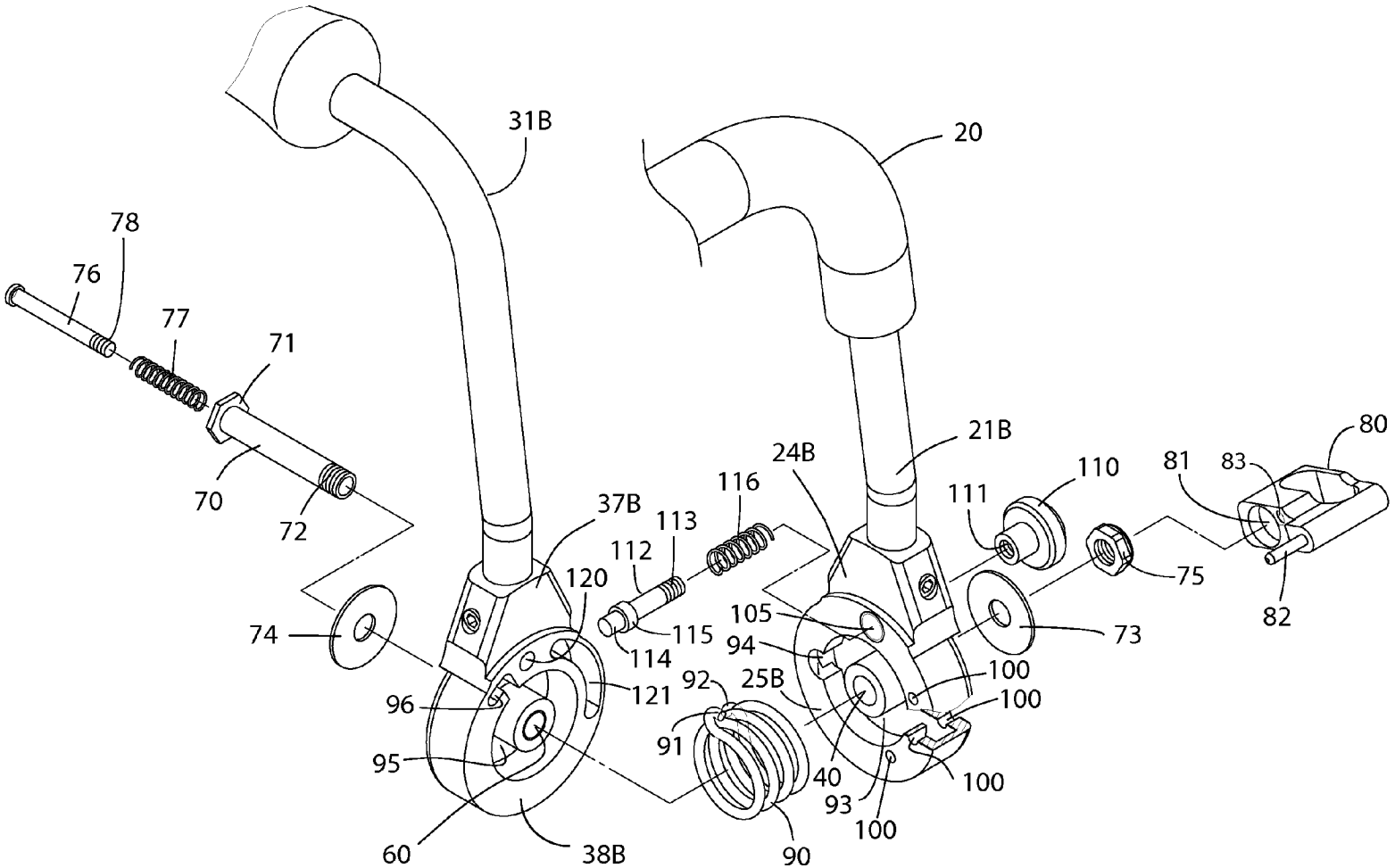
FIG. 3 is a partial exploded view of the apparatus illustrated in FIGS. 1 and 2.

FIGS. 1-3 depict an embodiment of an abdominal fitness apparatus 10 of the present invention. FIGS. 1 and 2 illustrate an assembled view of the embodiment comprising a U-bar 20 having two U-bar end sections 21A and 21B and a U-bar median section 23; wherein the U-bar end sections 21A and 21B and the U-bar median section 23 are essentially coplanar; and wherein the U-bar end sections are each terminated with mirror-image U-bar rotatable hinge components 24A and 24B respectively. The abdominal fitness apparatus 10 further comprises a first L-bar 31A having first L-bar distal section 32A and a first L-bar proximal section 35A, and a second L-bar 31B having second L-bar distal section 32B and a second L-bar proximal section 35B. The first L-bar proximal section 35A is terminated with first L-bar rotatable hinge component 37A and the second L-bar proximal section 35B is terminated with second L-bar rotatable hinge component 37B; wherein the two U-bar rotatable hinge components 24A and 24B are configured to mate with the two L-bar rotatable hinge components 37A and 37B respectively.

FIG. 2 depicts the apparatus 10 as depicted in FIG. 1; wherein the second L-bar 31B has been independently rotated such that L-bar distal section 32B has been moved toward the U-bar 20, while the first L-bar 31A remains in the same position as depicted in FIG. 1. Also, in apparatus 10 the U-bar median section 23 is contoured to accommodate the chest of a person using the apparatus. Such a contoured configuration of U-bar median section 23 is an optional feature of the invention.

FIG. 3 presents an exploded view of the U-bar hinge component 24B and the L-bar hinge component 37B illustrating internal details of the overall rotatable hinge mechanism, wherein the rotatable hinge components 24B and 37B are configured to rotate about a hollow pivot pin 70. The mirror image rotatable hinge components 24A and 37A are also configured to rotate about another pivot point 70 (not shown). By this configuration the first L-bar 31A and second L-bar 31B can be independently rotated with respect to the U-bar 20.

FIG. 3 also illustrates the U-bar hinge component 24B, having a U-bar hinge component internal surface 25B, and L-bar hinge component 37B, having a L-bar hinge component internal surface 38B, each configured to define U-bar hinge component circular pivot pin hole 40 and L-bar hinge component circular pivot pin hole 60 respectively extending there through and sized to accommodate hollow tubular pivot pin 70 having a proximal end, a distal end, an exterior surface and a lumen, which is also known as an interior surface; wherein the pivot pin 70 comprises a hexagonal flange 71 at the proximal end and a screw thread 72 around the surface of the distal end; and wherein the screw thread 72 is mated to a pivot pin retainer nut 75. This embodiment further comprises optional hinge component gaskets 73 and 74. The rotatable hinge assembly further comprises a pivot pin internal rod 76 sized to extend through a pivot pin compression spring 77, such that the internal rod 76 and pivot pin compression spring 77 in combination extend through the lumen of the pivot pin 70. The rotatable hinge assembly further comprises a spring torque adjustment knob 80, which is configured to define an torque adjustment knob opening 81 sized to accommodate the pivot pin retainer nut 75; and a threaded hole 83 mated to the threaded distal end 78 of pivot pin internal rod 76. The torque adjustment knob 80 further comprises a torque adjustment knob pin 82 disposed adjacent to torque adjustment knob opening 81 and extending along an axis parallel to the axis of the pivot pin 70. When the rotatable hinge assembly of abdominal fitness apparatus 10 is fully assembled, the arrangement of components enables movement of the pivot pin compression spring 77 along the longitudinal axis of pivot pin 70 by extending or depressing the adjustment knob 80, such that when the adjustment knob 80 is extended, i.e. pulled away from the U-bar hinge component 24B, the compression spring 77 is compressed and when the adjustment knob 80 is subsequently released the compression spring 77 returns to a relaxed state.

Also depicted in FIG. 3 is a torsion spring 90 having a torsion spring first hook-shaped end 91 and a torsion spring second hook-shaped end 92. Such a torsion spring is also commonly referred to as a torque spring. Approximately half of the body of the torsion spring 90 is disposed within a U-bar hinge component embedding groove 93 circumferentially disposed about circular pivot pin hole 40 extending into the U-bar hinge component internal surface 25B and thereafter extending towards the periphery of the U-bar hinge component 24B. The torsion spring second hook-shaped end 92 is disposed through a torsion spring access notch 94 that extends into the U-bar hinge component internal surface 25B and which is contiguous with the U-bar hinge component embedding groove 93. The U-bar hinge component 24B is further configured to define three torque adjusting knob pin holes 100 extending though the hinge component 24B and parallel to the longitudinal axis of circular pivot pin hole 40. The adjusting knob pin holes 100 are arranged circumferentially about the circular pivot pin hole 40 at desired intervals and are dimensioned to accept the torque adjustment knob pin 82 extending there through. The other approximately half of the body of the torsion spring 90 is disposed within a torsion spring embedding groove 95 that extends into the U-bar hinge component internal surface 38B and which is circumferentially disposed about circular pivot pin hole 60; wherein the torsion spring first hook-shaped end 91 is embedded and retained in a torsion spring retainer notch 96 that extends into the L-bar hinge component internal surface 38B and which is contiguous with the torsion spring embedding groove 95.

By this arrangement, when the rotatable hinge mechanism is assembled, the torque adjusting knob 80 can be fully depressed such that the torque adjusting knob pin 82 is inserted into and extends through a chosen one of the torque adjusting knob pin holes 100 such that the torsion spring second hook-shaped end 92 is engaged by the torque adjusting knob pin 82 to set a desired resistance level to the torsion spring 90, wherein the torque adjusting knob 80 is retained in this position aided by the arrangement of the pivot pin compression spring 77 and the pivot pin internal rod 76. When the aforementioned components as depicted in FIGS. 1, 2 and 3 are fully assembled, and the torque adjusting knob 80 is positioned such that the adjusting knob pin 82 is fully seated within in a desired adjusting knob pin holes 100, the torsion spring 90 provides a desired relative rotational resistance between the U-bar 20 and the L-bars 31A and 31B and such a configuration allows the resistance to rotation of the U-bar 20 relative to the L-bars 31A and 31B to be conveniently varied by a user without disassembly of the rotatable hinge mechanisms. Although the embodiment depicted in FIGS. 1-14 depicts three of such torque adjusting knob pin holes, the number of such torque adjusting knob pin holes, and therefore the number of discreet resistance levels obtainable, is in no way limited by the embodiment depicted and other embodiments may contain any plurality of torque adjusting knob pin holes greater than one.

Additionally, the U-bar rotatable hinge component 24B is configured to define an operation setting pin first hole 105 extending through the hinge component 24B and parallel to the longitudinal axis of circular pivot pin hole 40. The operation setting pin first hole 105 is dimensioned to accommodate the shaft of the operation setting pin 112, which has an externally threaded operation proximal end 113 having a thread mated to the an internal thread 111 in an operation setting knob 110. The operation setting pin 112 is configured to define a setting pin collar 115 disposed near the distal end 114 and having a diameter greater than that of the distal end 114 and the proximately threaded shaft.

The L-bar hinge component 37B is further configured to define an operation setting second pin hole 120, which is dimensioned to accommodate the distal end 114 of the operation setting pin 112; and an arc shaped operation setting pin slot 121 positioned circumferentially about the circular pivot pin hole 60 and proximate to the operation setting second pin hole 120; wherein the arc shaped operation setting pin slot 121 is dimensioned to accommodate the distal end 114 of the operation setting pin 112. Also an operation setting pin collar 115 is disposed circumferentially about the operation setting pin 112 near the operation setting pin distal end 114. An operation setting pin compression spring 116 is dimensioned to accommodate the threaded shaft of the operation setting pin 112 disposed there through, while having a diameter greater that of the operation setting pin first hole 105. The compression spring 116 provides a force for pushing the distal end 114 of the operation-setting pin 112 into the operation-setting second pin hole 120 or the operation-setting pin slot 121. By this arrangement, when the rotatable hinge mechanism is assembled, the operation-setting knob 110 can be retracted thereby disengaging the distal end 114 of the setting pin 112 from either the second setting pin hole 120 or the setting pin slot 121; and whereby the operation-setting knob 110 can be depressed to retain the distal end 114 of the setting pin 112 in either the second setting pin hole 120 or within the setting pin slot 121. The arc shaped operation setting pin slot 121 in this depicted embodiment has an arc of approximately 90°, however in other embodiments the arc can range from about 45° to 305°, preferably from 45° to 180° and most preferably from about 75° to 105°.

Figure 4:
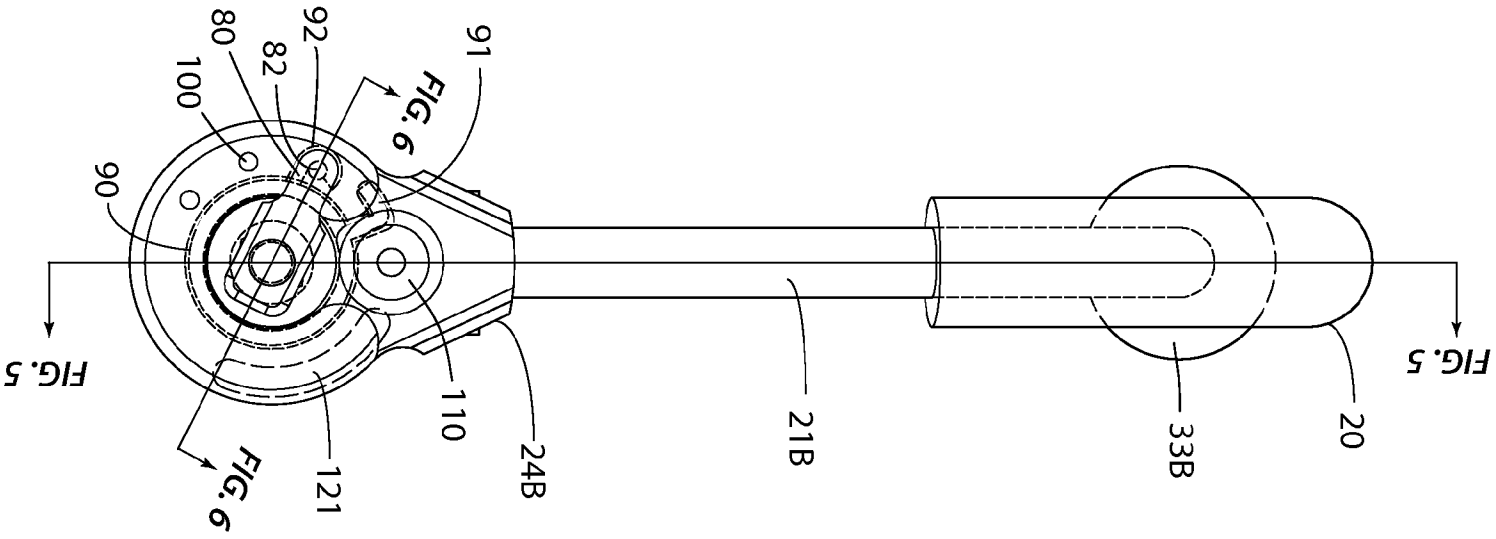
FIG. 4 is an orthogonal side view of the apparatus illustrated in FIG. 1 shown in a storage configuration.
Figure 5:
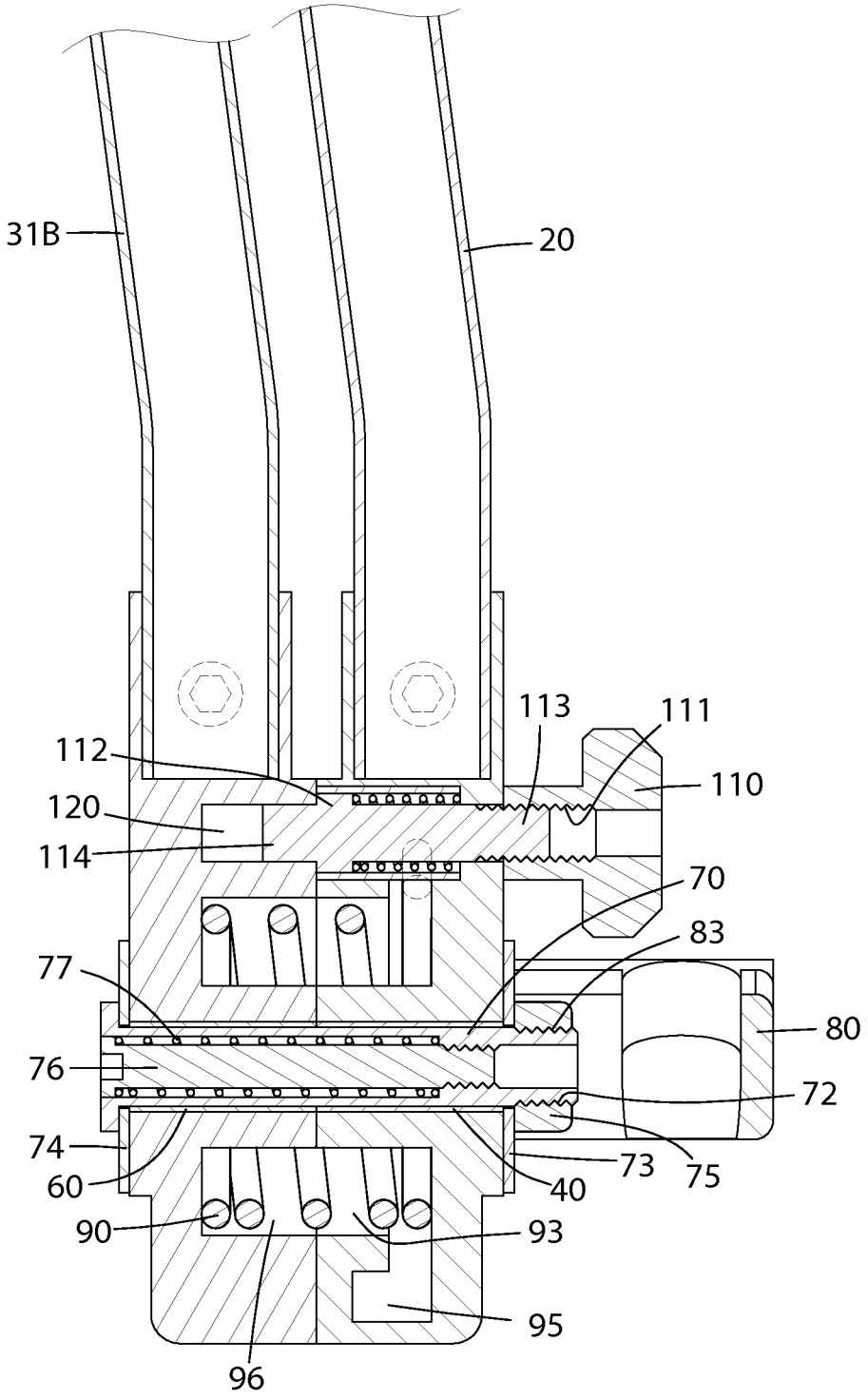
FIG. 5 is a cross-sectional view of a portion of FIG. 4.
Figure 13:
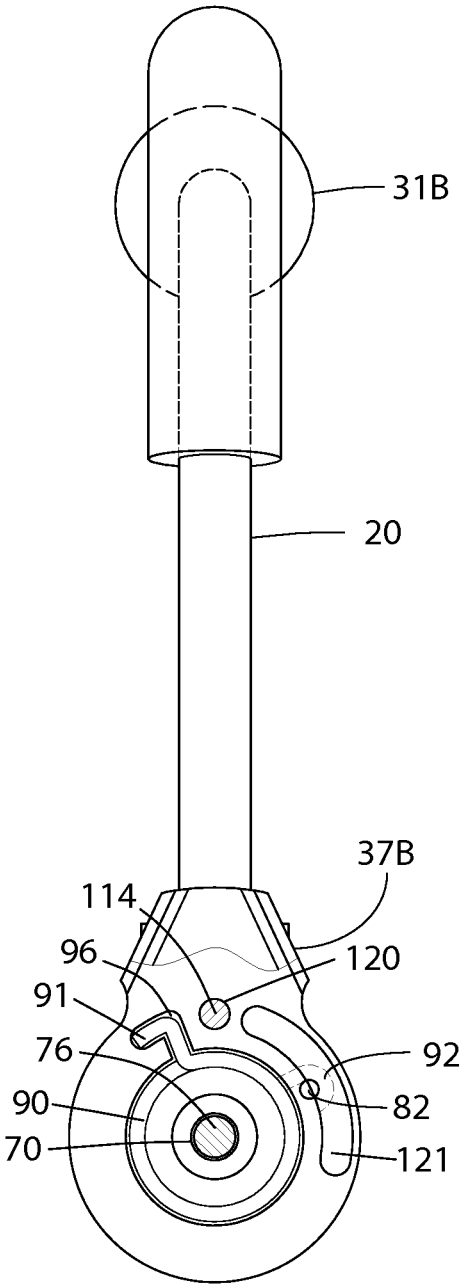
FIG. 13 is an orthogonal side view of the apparatus illustrated in FIG. 1 shown in a storage configuration.
Figure 14:
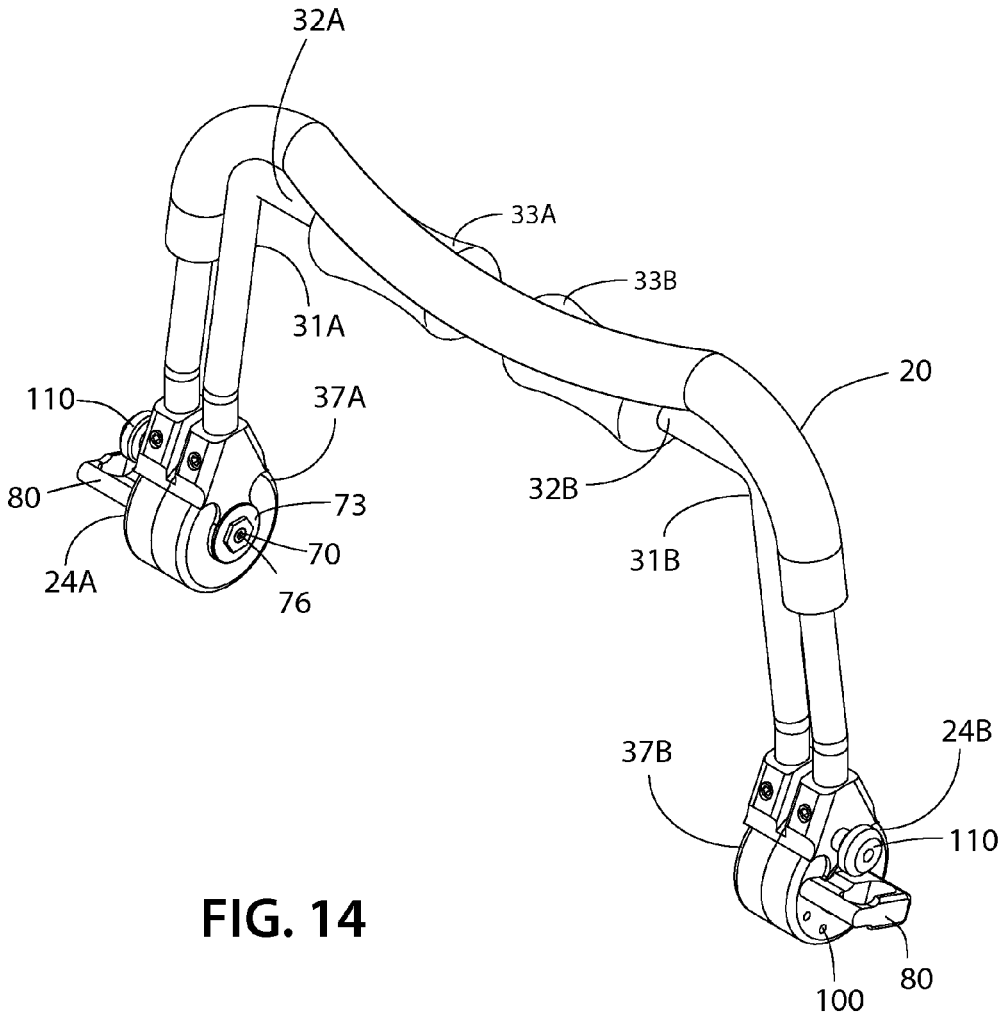
FIG. 14 is a perspective view of the apparatus illustrated in FIG. 1 shown in a storage configuration.

By use of the operation-setting knobs 110, the U-bar 20 and the L-bars 31A and 31B can be set to an operation or idle mode. In an operation mode, as shown in FIG. 4, FIG. 5 and FIG. 13, the U-bar 20 and the L-bar 31B (for simplicity L-bar 31A is not shown) apparatus 10 are in the storage position as illustrated in FIG. 14, wherein the U-bar end section 21B and the L-bar proximal section 35B are parallel or nearly parallel such that the roller 33B is at least partly disposed beneath the U-bar median section 23. Such a storage position is achieved and retained by pulling the operation setting knob 110 until the operation setting pin 114 is completely disengaged from the L-bar hinge rotatable component 37B, rotating the L-bar relative to the U-bar until the U-bar end section 21B and the L-bar proximal section 35B are essentially parallel and the releasing the operation setting knob 110 such that the operation setting pin 114 is engaged by the setting pin hole 120.

Figure 7:
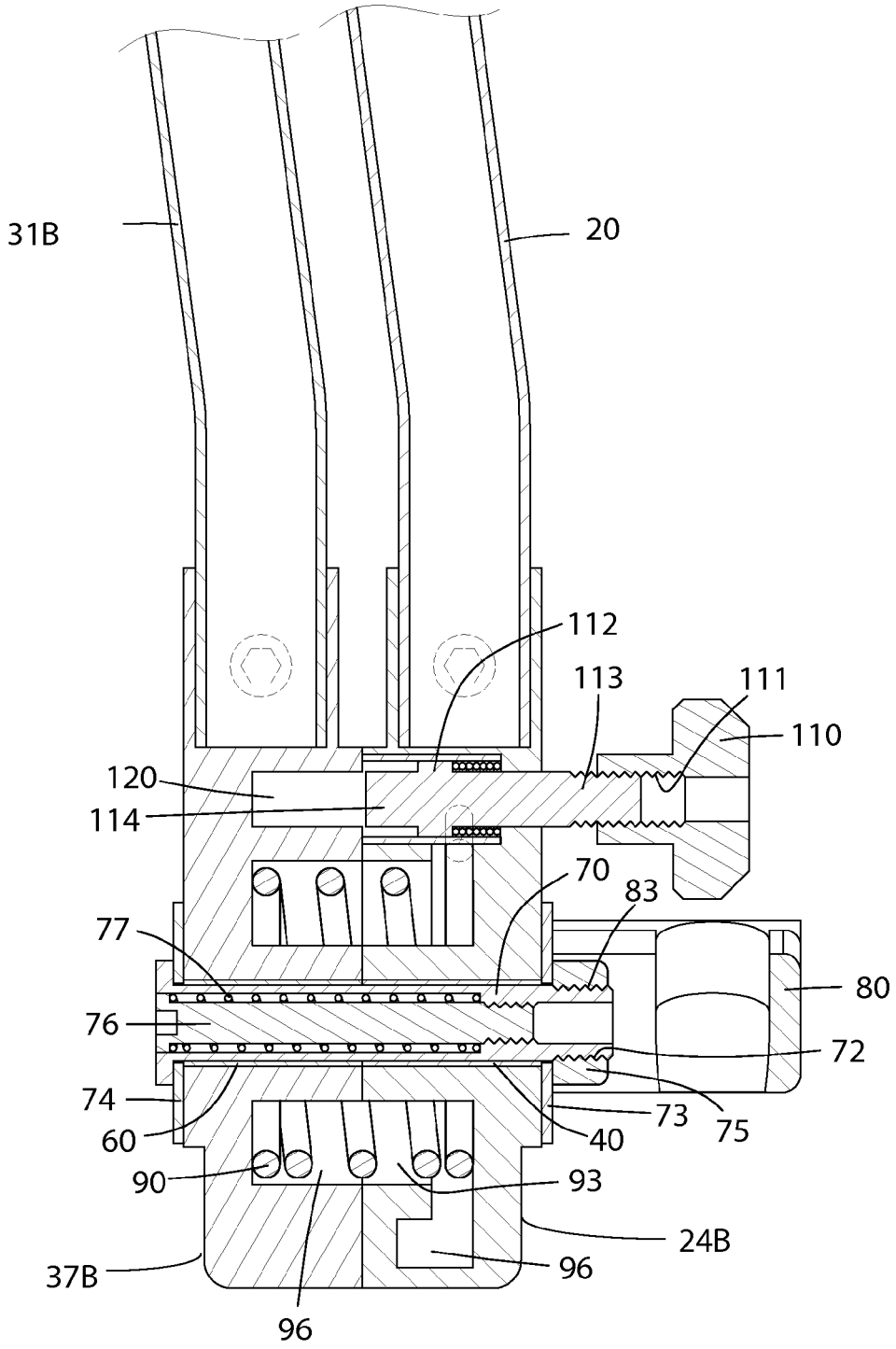
FIG. 7 is cross-sectional view of a portion of the apparatus illustrated in FIG. 1.
Figure 9:
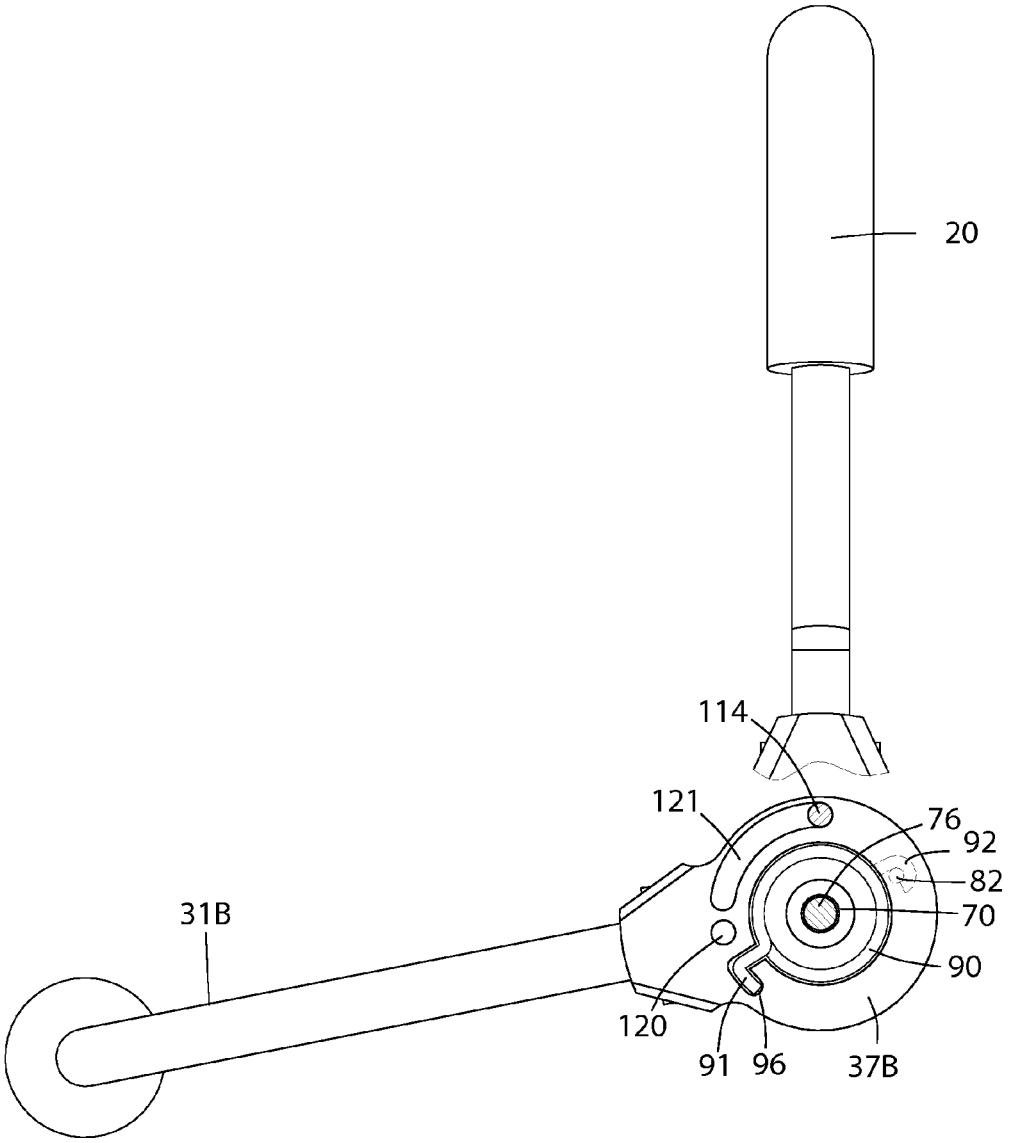
FIG. 9 is an orthogonal side view of an application of the apparatus illustrated in FIG. 1.
Figure 10:
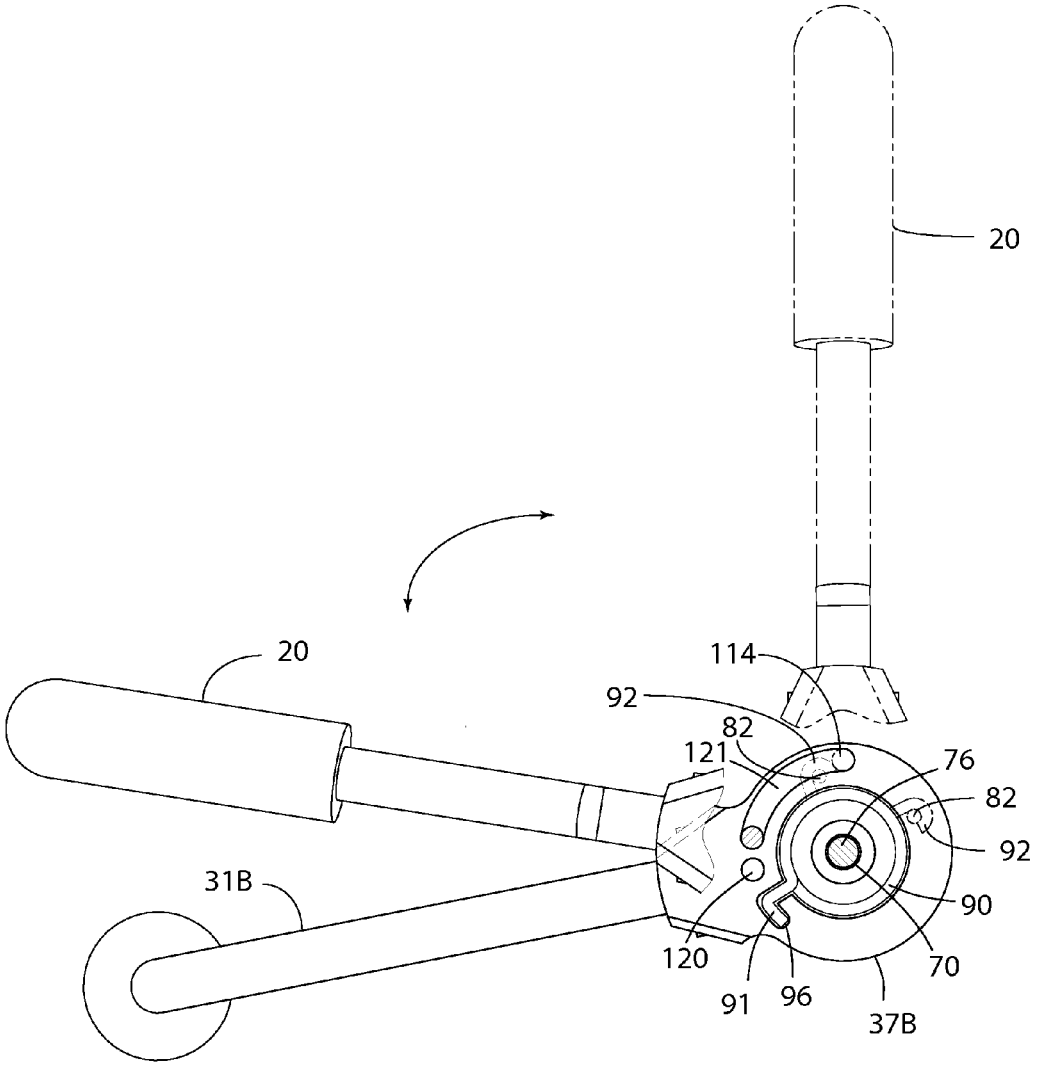
FIG. 10 presents an orthogonal side view of an application of the apparatus illustrated in FIG. 1.
Figure 11:
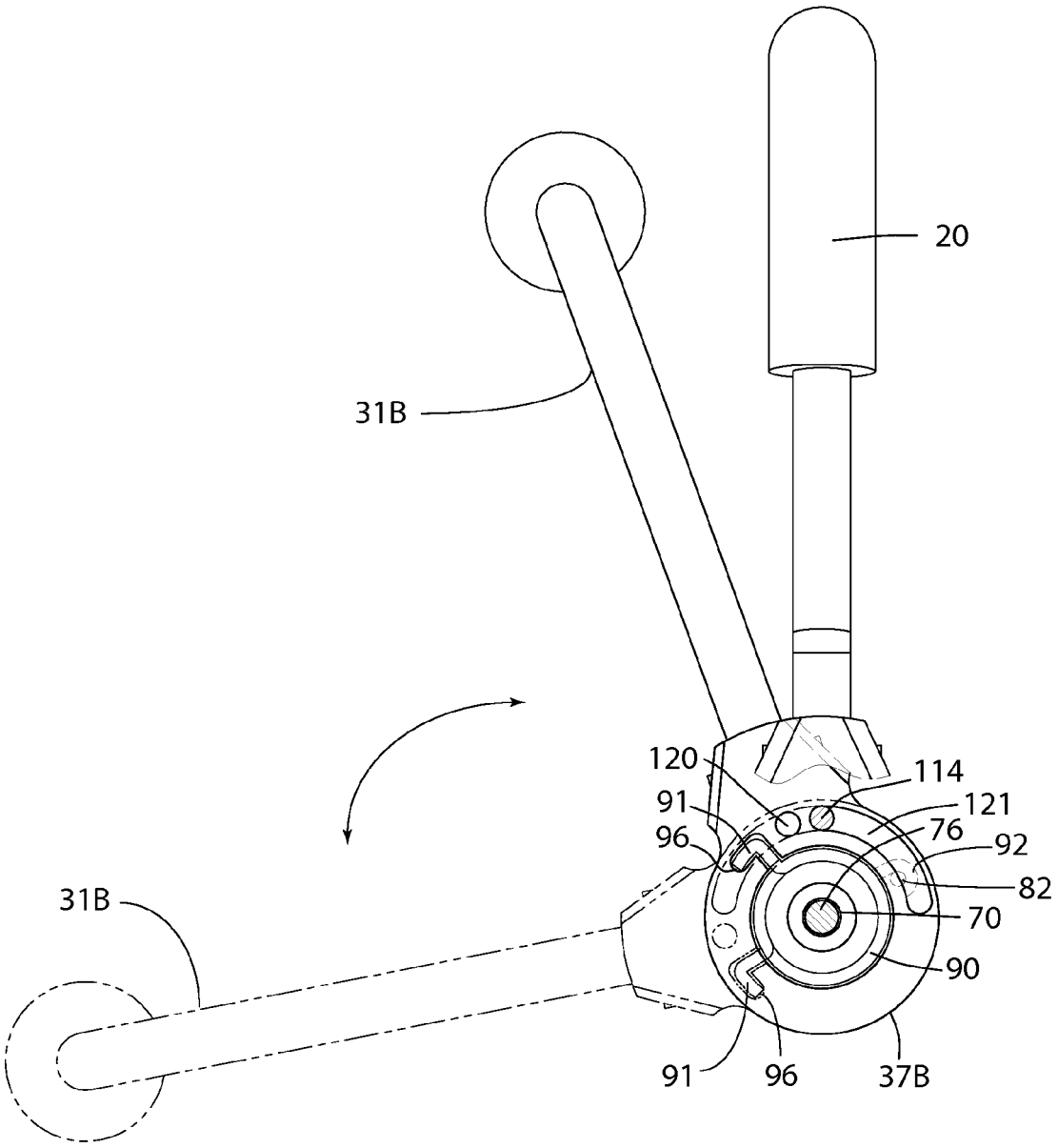
FIG. 11 presents an orthogonal side view of an application of the apparatus illustrated in FIG. 1.

When the two operation-setting knobs 110 are adjusted and pulled outward as shown in FIG. 7, the distal ends 114 of the operation setting pins 112 are withdrawn from the operation setting second pin hole 120, wherein an L-bar rotatable hinge component 37A or 37B is rotated to effect insertion of the distal end 114 of an operation setting pin 112 into the operation setting pin slot 121 as depicted in FIG. 9, FIG. 10 and FIG. 11, wherein the U-bar 20 and L-bars 31A and 31B are angularly disposed in various configurations such that a user can operate the apparatus 10 to perform various exercises.

Figure 6:
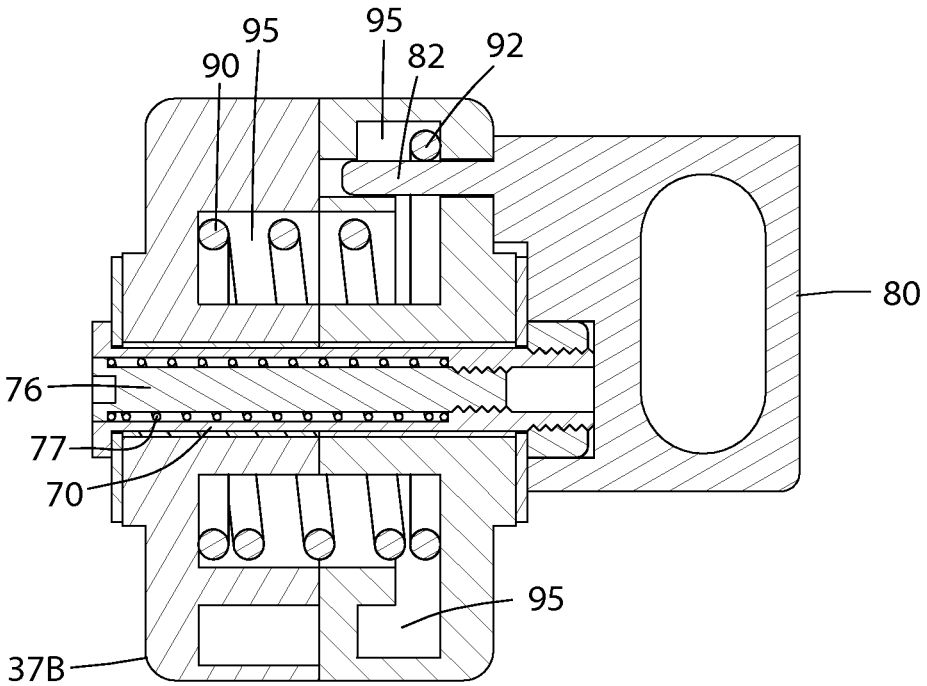
FIG. 6 is a cross-sectional view of a portion of FIG. 4.
Figure 12:
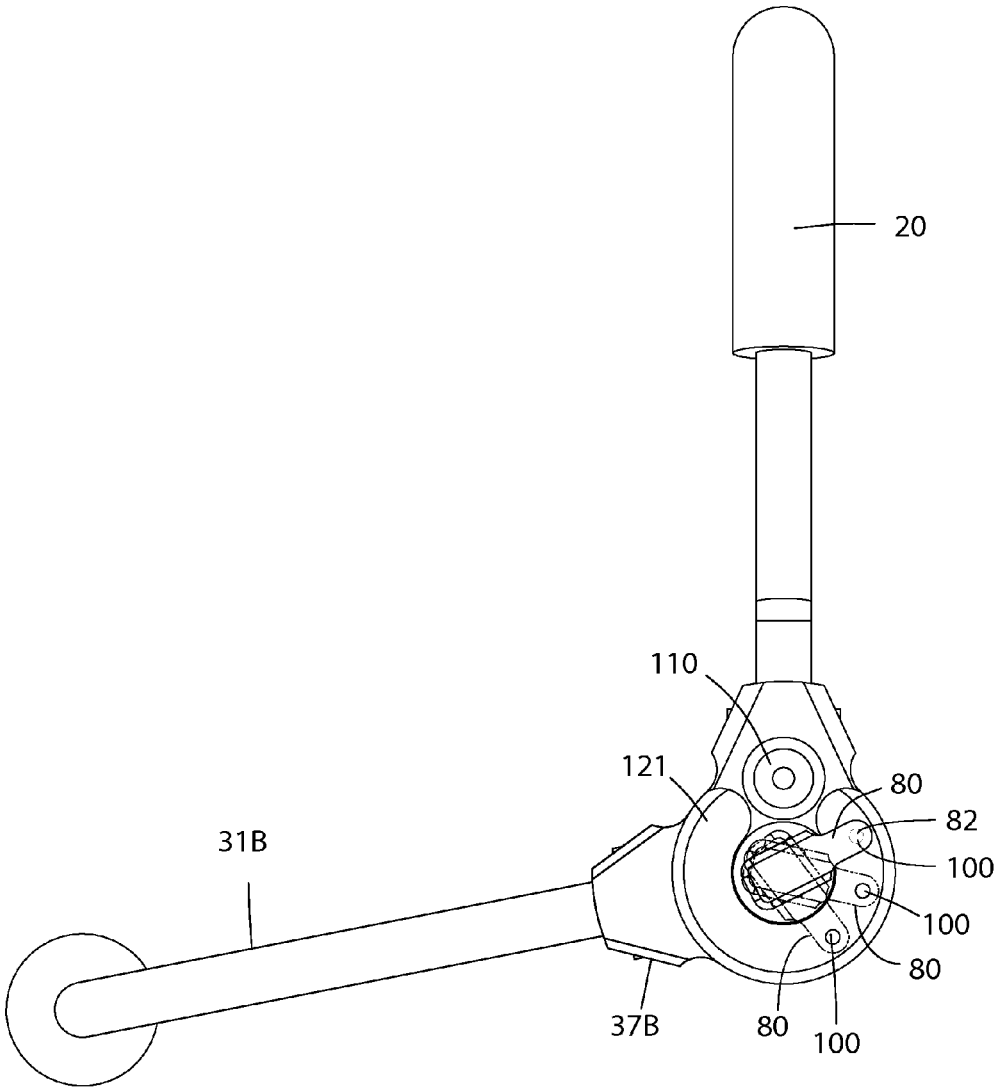
FIG. 12 presents an orthogonal side view of an application of the apparatus illustrated in FIG. 1.

With reference to FIG. 3, the torsion spring 90 has a hook-shaped end 91 secured into a torsion spring retainer notch 96 in a L-bar hinge component internal surface 38A or 38B and a hook-shaped end 92 disposed within torsion spring access notch 94 in U-bar hinge component internal surface 28A or 28B. Since the hook-shaped end 92 of a torsion spring 90 is movable, when the U-bar 20 and an L-bars 31A or 31B are moved with respect to each other for the use in the exercise, the hook-shaped end 92 will move and the adjusting knob pin 82 of the spring torque adjustment knob 80 will be fixed in a position (as shown in FIG. 6) such that that the hook end 92 of the torsion spring 90 becomes fixed. Since the hook-shaped end 91 of the torsion spring 90 is fixed within a rotatable hinge component 37A or 37B of an L-bars 31A or 31B and the hook-shaped end 92 is fixed by the adjusting knob pin 82 within a rotatable hinge component 24A or 24B of the U-bar 20, both of the U-bar 20 and an L-bar 31A or 31B can be moved with respect to each other by overcoming the resistance of the torsion spring 90. In addition, the resistance imposed by torsion spring 90 can be easily adjusted by controlling the insertion of the adjusting knob pin 82 of the spring torque adjustment knob 80 into one of the various torque adjusting knob pin holes 100 as depicted in FIG. 12.

When the abdominal fitness machine is not in use, the operation setting knob 110 can be pulled outward permitting the U-bar 20 and the L-bars 31A or 31B to be turned towards one another such that the operation setting second pin hole 120 is aligned precisely with distal end 114 of the operation setting pin 112. When the operation-setting knob 110 is released, the distal end 114 of the operation-setting pin 112 is moved back by the force of the operation setting pin compression spring 116 and embedded into the operation setting second pin hole 120 as depicted in FIGS. 13 and 14. In such a configuration, the U-bar 20 and the L-bars 31A or 31B are secured to one another for convenient storage.

Certain embodiments of the apparatus are configured such that the L-bar(s) must be disposed at or near (within about 10°) a storage position in order to change the tension setting.

Below are descriptions of several exercises that can be executed by an individual utilizing an apparatus of the present invention.

Figure 8A:
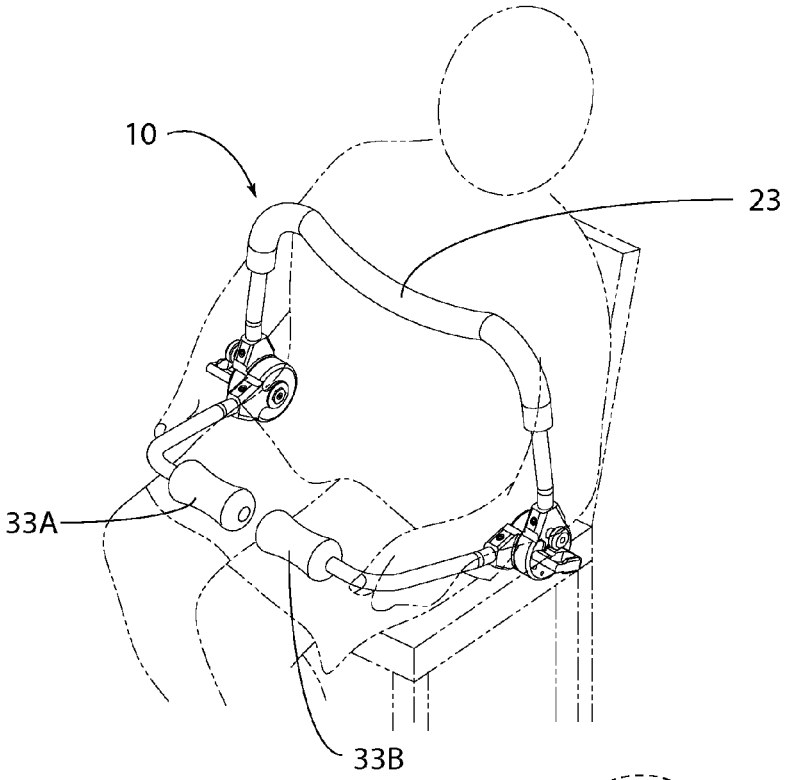
FIGS. 8A and 8B are perspective views of the apparatus illustrated in FIG. 1 being utilized for an abdominal muscle exercise.
Figure 8B:
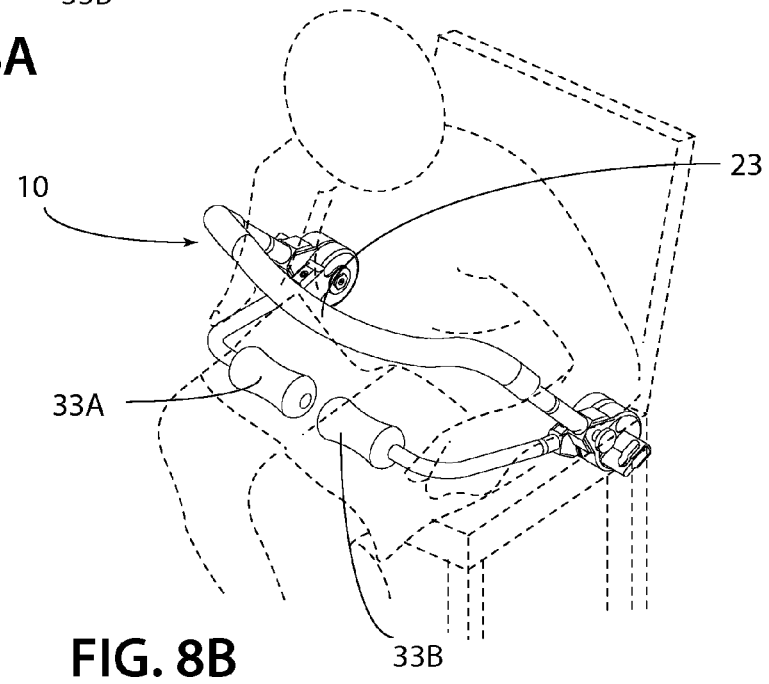

FIG. 8A depicts a user utilizing apparatus 10 in a position to execute an abdominal muscle exercise wherein a user is seated with the rollers 33A and 33B resting on the thighs, wherein the U-bar median section 23 leans against the chest. To execute the exercise the legs remains in the position shown and the chest pushes the U-bar median section 23 downwardly towards the rollers 33A and 33B to overcome the resistance of the torsion spring as shown in FIG. 8B, wherein the movement is repeated as desired to perform various abdominal fitness and abdomen reduction exercises routines. From this same starting position of FIG. 8A, the user's can maintain the back erect such that the chest becomes a support surface for the U-bar median section 23 and wherein the user can lift the left and right legs alternately, or in unison, wherein the force provided by the user's thighs overcomes the resistance of the torque spring 90 to move an L-bar rollers 33A and 33B towards the U-bar median section 23 to effect a thigh strength training exercise.

Figure 15A:
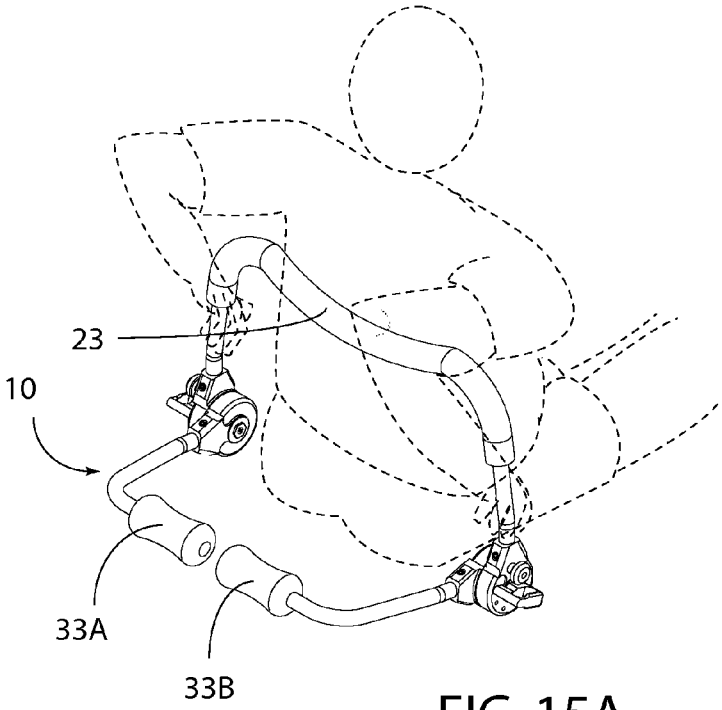
FIGS. 15A and 15B are perspective views of the apparatus illustrated in FIG. 1 being utilized for strengthening the muscles of the back as well as the abdomen.
Figure 15B:
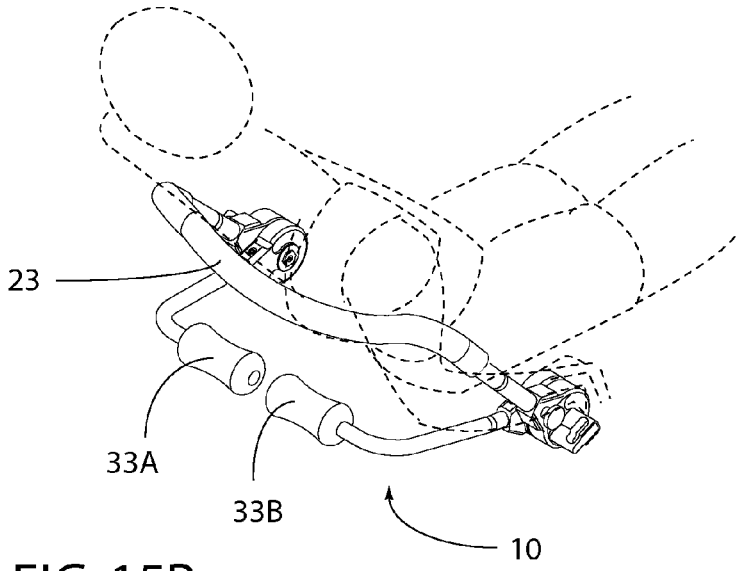

FIGS. 15A and 15B depict a user utilizing apparatus 10 to execute an exercise for strengthening muscles of the back as well as the abdomen. The starting position for this exercise is depicted in FIG. 15A wherein each L-bar is set at an angle approximately 90° with respect to the U-bar and a user is seated such that the U-bar median section 23 is positioned against the back of the user and the L-bars are positioned to extend away from the user such that the rollers 33A and 33B rest upon the surface on which the user is seated. To execute the exercise the user leans back to push the U-bar median section 23 downwardly towards the rollers 33A and 33B as shown in FIG. 15B and then returns to the starting position. To facilitate this exercise the user holds the apparatus 10 in place with the hands while executing the exercise.

Figure 16A:
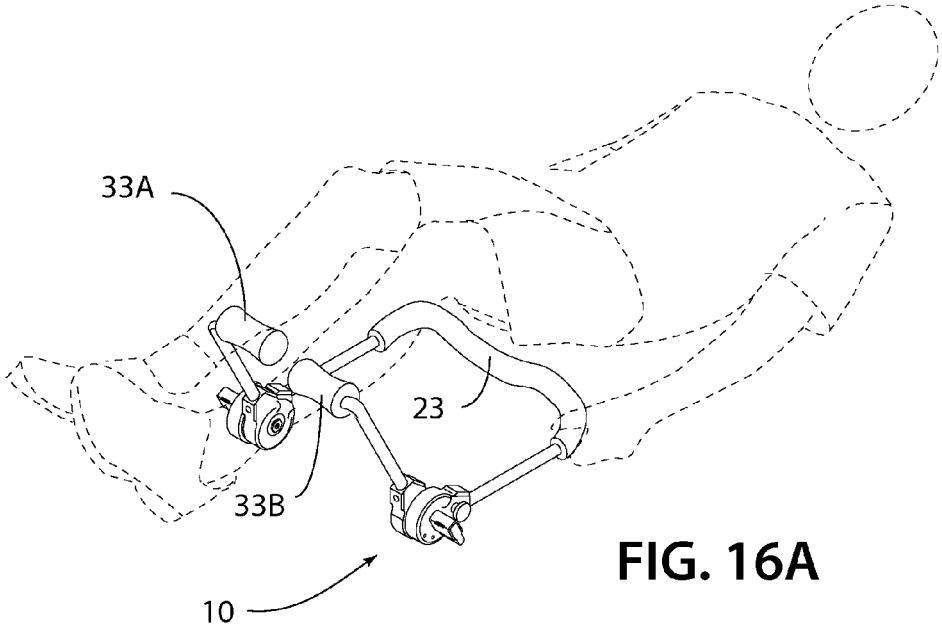
FIGS. 16A and 16B are perspective views of the apparatus illustrated in FIG. 1 being utilized for an exercise to strengthen the muscles of the legs.
Figure 16B:
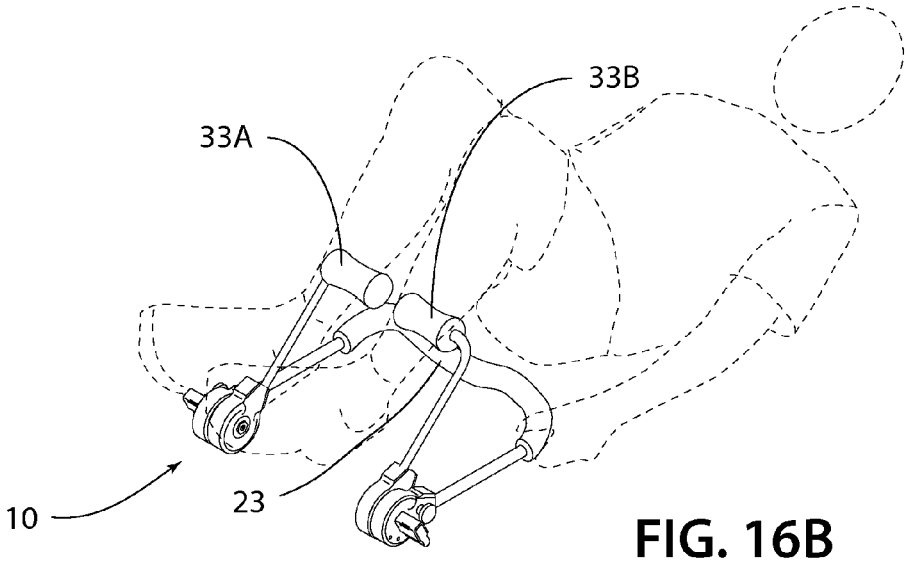

FIGS. 16A and 16B depict a user utilizing apparatus 10 to execute an exercise for strengthening muscles of the legs. The starting position for this exercise is depicted in FIG. 16A wherein each of the L-bars is set at an angle approximately 90° with respect to the U-bar and a user is lying on a flat surface with his or her lower back against the flat surface. The U-bar median section 23 is positioned against or near the user's buttocks and the L-bars are positioned to upward from the flat surface. By bending the knees the user positions his or her calves such they rest on the rollers 33A and 33B. To execute the exercise the user pulls his or her feet towards the buttocks wherein the backs of the calves to push the rollers 33A and 33B the downwardly towards the U-bar median section 23 as shown in FIG. 16B. The user then returns to the starting position. To facilitate this exercise the user holds the apparatus 10 in place with the hands while executing the exercise.

Figure 17A:
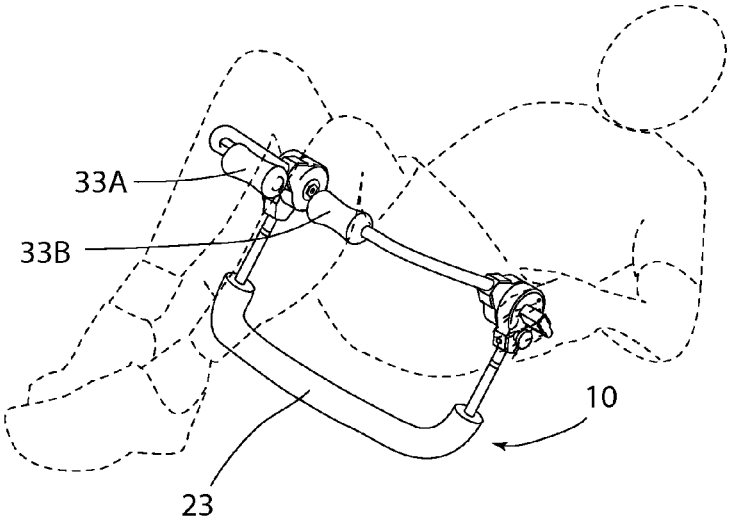
FIGS. 17A and 17B are perspective views of the apparatus illustrated in FIG. 1 being utilized for an exercise to strengthen the gluteal muscles.
Figure 17B:
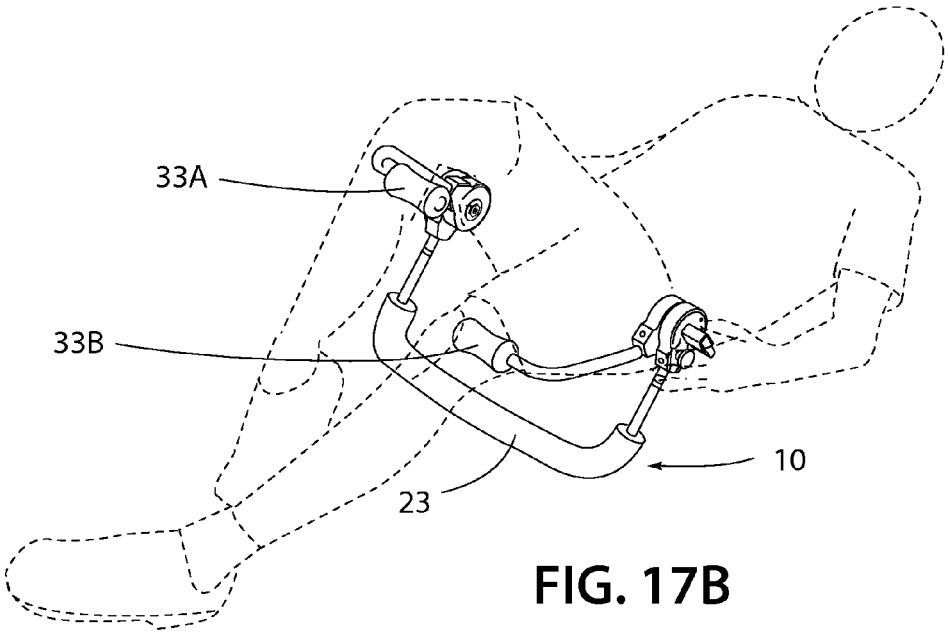

FIGS. 17A and 17B depict a user utilizing apparatus 10 to execute an exercise for strengthening the gluteal muscles. The starting position for this exercise is depicted in FIG. 17A wherein each of the L-bars is set at an angle approximately 90° with respect to the U-bar and a user is lying on a flat surface with his or her lower back against the flat surface. The U-bar median section 23 is positioned against the flat surface near the user's buttocks a with the U-bar proximal sections extending upward towards the user's head at an angle of about 45°. By bending the knees the user positions the backs of the upper portions of his or her calves such they rest on the rollers 33A and 33B. To execute the exercise the user straightens his or her legs wherein the backs of the thighs push the rollers 33A and 33B the downwardly towards the U-bar median section 23 as shown in FIG. 17B. The user then returns to the starting position. To facilitate this exercise the user holds the apparatus 10 in place with the hands while executing the exercise. This exercise can be executed with one leg at a time or with both legs in unison.

The lateral abdominal muscles are the muscles used when a person rotates the upper body or leans side-to-side. Technically, the lateral abdominal muscles are more properly referred to as the internal oblique and external oblique muscles, which are often collectively referred to as "the obliques". For the purposed of the present invention lateral abdominal muscles and obliques have the same meaning.

Figure 18A:
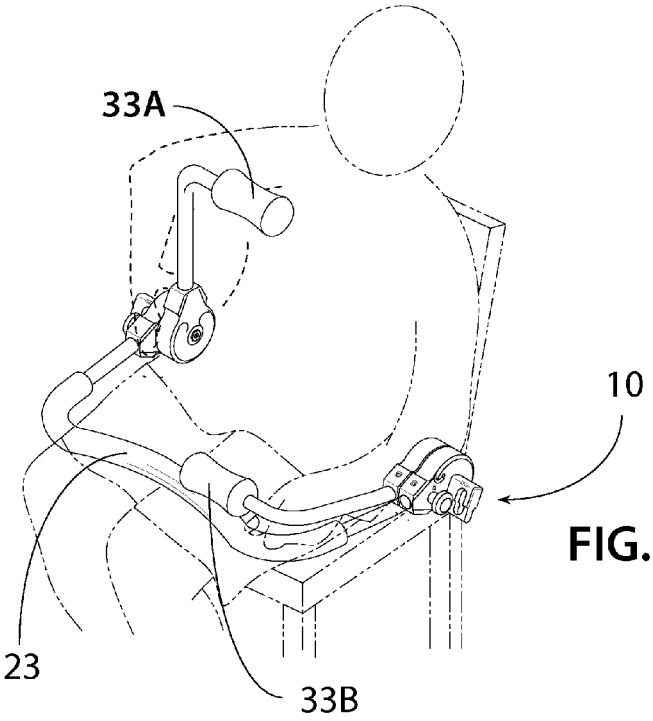
FIGS. 18A and 18B are perspective views of the apparatus illustrated in FIG. 1 being utilized for an exercise to strengthen the lateral abdominal muscles.
Figure 18B:
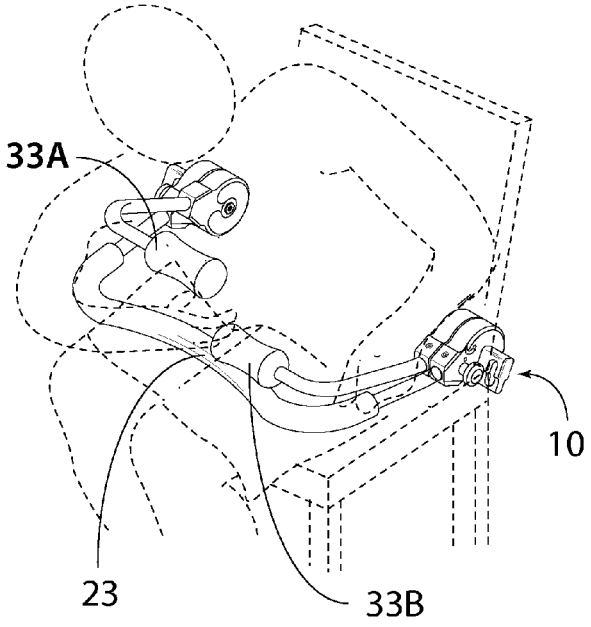

FIGS. 18A and 18B depict a user utilizing apparatus 10 to execute an exercise for strengthening the lateral abdominal muscles. FIG. 18A depicts a user utilizing apparatus 10 in a starting position to execute a lateral abdominal muscle exercise wherein a user is seated with the U-bar median section 23 resting against the tops of the user's thighs and wherein the roller 33A is disposed against the user's chest while the roller 33B is disposed against the median section 23. To execute the exercise the user's legs remains in the stating position as shown, while the user rotates at the waist and the chest pushes the roller 33A downwardly towards the median section 23 to overcome the resistance of the torsion spring as shown in FIG. 18B, wherein the movement is repeated as desired. The lateral abdominal muscle exercise may also be performed with the opposite side of the body wherein a user is seated with the U-bar median section 23 resting against the tops of the user's thighs and wherein the roller 33B is disposed against the user's chest while the roller 33A is disposed against the median section 23. To execute the exercise the user's legs remains in the stating position as shown, while the user rotates at the waist and the chest pushes the roller 33B downwardly towards the median section 23 to overcome the resistance of the torsion spring.

In summation of the description above, exercise apparatuses of the present invention provide various abdominal fitness and abdomen reduction and other exercises to strengthen other muscles of a user such as muscles of the legs and back. Such exercise apparatuses are compact and allow a user to easily adjust the resistance load foe each side of the apparatus independently for a desired training regime by use of a simple spring torque-adjusting knob.

While the invention has been described with respect to specific embodiments, those skilled in the art with recognize that numerous modifications and variations could be made without departing from the scope and spirit of the invention herein described and set forth in the claims.

We claim:

1. An exercise apparatus comprising:

a U-bar with a first U-bar end section, a second U-bar end section and a U-bar median section; wherein the first U-bar end section, the second U-bar end section and the U-bar median section are essentially coplanar and wherein each of the U-bar end sections is perpendicular to the U-bar median section; wherein each U-bar end section comprises a U-bar hinge component having a U-bar hinge component internal surface and wherein each U-bar hinge component is configured to define a U-bar hinge component pivot pin hole extending therethrough; and two mirror-imaged L-bars each having an L-bar proximal end and an L-bar distal end, wherein each L-bar proximal end comprises an L-bar hinge component having an L-bar hinge component internal surface wherein each L-bar hinge component internal surface is mated to one of the corresponding U-bar hinge component internal surfaces and wherein each L-bar hinge component is configured to define an L-bar hinge component pivot pin hole extending therethrough; and two pivot pins each having a proximal end, a distal end and a longitudinal axis, wherein the distal end of one pivot pin extend through each of the U-bar pivot pin holes and the corresponding L-bar pivot pin hole to provide a first rotatable hinge assembly and a second rotatable hinge assembly such that each L-bar is independently rotatable with respect to the U-bar and wherein each L-bar proximal section rotates in a plane parallel to the plane of the first and second U-bar sections; wherein each rotatable hinge assembly comprises a torsion spring having a first hook-shaped end and a second hook-shaped end wherein the torsion spring first hook-shaped end is disposed within an L-bar hinge component torsion spring embedding groove circumferentially disposed about the L-bar pivot pin hole and extending into the L-bar hinge component internal surface and wherein the torsion spring first hook-shaped end is embedded and retained in an L-bar hinge component torsion spring retainer notch extending into the L-bar hinge component internal surface and which is contiguous with the L-bar hinge component torsion spring embedding groove; wherein the torsion spring second hook-shaped end is disposed within a U-bar hinge component embedding groove circumferentially disposed about the U-bar hinge component pivot pin hole and extending into the mating U-bar hinge component internal surface; wherein the torsion spring second hook-shaped end is embedded and retained in a U-bar hinge component torsion spring retainer notch extending into the U-bar hinge component internal surface and which is contiguous with the U-bar hinge component torsion spring embedding groove; and wherein each hinge assembly comprises a torsion spring tension setting means configured to vary tension of the torsion spring and to secure the torsion spring at two or more distinct tension settings without disassembly of the apparatus to provide two or more distinct desired levels of resistance to the relative rotation of each L-bar independently with respect to the U-bar.

2. The apparatus of claim 1, wherein the operation setting means comprise an operation setting pin having a proximal end and a distal end and an operation setting pin knob attached to the operation setting pin proximal end, wherein the operation setting pin is disposed within an operation setting pin hole extending through each U-bar hinge component parallel to the longitudinal axis of the pivot pin, and wherein the internal surface of each mating L-bar hinge component is configured to define an operation setting pin hole and an arc shaped operation setting pin slot positioned circumferentially about the pivot pin hole and proximate to the operation setting second pin hole; wherein both the operation setting pin holes and the arc shaped operation setting pin slots are dimensioned to accommodate the distal end of the operation setting pin.

3. The apparatus of claim 2, wherein the arc shaped operation setting pin slot has an arc in the range of 75° to 105°.

4. The apparatus of claim 3, wherein the arc shaped operation setting pin slot has an arc of about 90°.

5. The apparatus of claim 2, wherein the arc shaped operation setting pin slot has an arc of about 90° and wherein each L-bar comprises a cylindrical roller circumferentially disposed about the L-bar distal section.

6. The apparatus of claim 1, wherein the pivot pin comprises: a hollow cylinder with an exterior surface, a lumen, a flange at the proximal end and a screw thread about the exterior surface of the distal end, wherein the screw thread is mated to a pivot pin retainer nut; and a pivot pin internal rod and a pivot pin compression spring sized to accommodate the pivot pin internal rod, such that the internal rod and pivot pin compression spring in combination extend through the lumen of the pivot pin; and wherein the tension adjustment knob is configured to define an opening sized to accommodate the pivot pin retainer nut, wherein by such an arrangement the pivot pin compression spring is moved along the pivot pin longitudinal axis by extending or depressing the tension adjustment knob.

7. The apparatus of claim 1, wherein each L-bar comprises a cylindrical roller circumferentially disposed about the L-bar distal section.

8. The apparatus of claim 1, wherein the U-bar median section is contoured to conform to the chest of a user.

9. The Apparatus of claim 1, wherein the torsion spring tension setting means comprises a tension adjustment knob springedly coupled to, and rotatable about, the pivot pin distal end, wherein the tension adjustment knob comprises a tension adjustment knob pin disposed parallel to the longitudinal axis of the pivot pin; wherein the U-bar hinge components are each configured to define two or more adjustment knob pin holes extending though the U-bar hinge components embedding grooves while being disposed parallel to the longitudinal axis of, and arranged circumferentially about, the pivot pin and configured to accept the tension adjustment knob pin extended therethrough; wherein such an arrangement enables rotation of the tension adjustment knob as well as movement of the tension adjustment knob along the pivot pin longitudinal axis to enable insertion of the adjustment knob pin into a selected one of the two or more adjustment knob pin holes, so that the adjustment knob pin engages the torsion spring second hook-shaped end, thereby setting the level of resistance to the relative rotation of each L-bar independently with respect to the U-bar.

10. A method for exercising abdominal or thigh muscles of a person comprising the steps of:

(a) providing the exercise apparatus comprising: a U-bar with a first U-bar end section, a second U-bar end section and a U-bar median section; wherein the first U-bar end section, the second U-bar end section and the U-bar median section are essentially coplanar and wherein each of the U-bar end sections is perpendicular to the U-bar median section; wherein each U-bar end section comprises a U-bar hinge component having a U-bar hinge component internal surface and wherein each U-bar hinge component is configured to define a U-bar hinge component pivot pin hole extending therethrough; and two mirror-imaged L-bars each having an L-bar proximal end and an L-bar distal end, wherein each L-bar proximal end comprises an L-bar hinge component having an L-bar hinge component internal surface wherein each L-bar hinge component internal surface is mated to one of the corresponding U-bar hinge component internal surfaces and wherein each L-bar hinge component is configured to define an L-bar hinge component pivot pin hole extending therethrough; and two pivot pins each having a proximal end, a distal end and a longitudinal axis, wherein the distal end of one pivot pin extend through each of the U-bar pivot pin holes and the corresponding L-bar pivot pin hole to provide a first rotatable hinge assembly and a second rotatable hinge assembly such that each L-bar is independently rotatable with respect to the U-bar and wherein each L-bar proximal section rotates in a plane parallel to the plane of the first and second U-bar sections; wherein each rotatable hinge assembly comprises a torsion spring having a first hook-shaped end and a second hook-shaped end wherein the torsion spring first hook-shaped end is disposed within an L-bar hinge component torsion spring embedding groove circumferentially disposed about the L-bar pivot pin hole and extending into the L-bar hinge component internal surface and wherein the torsion spring first hook-shaped end is embedded and retained in an L-bar hinge component torsion spring retainer notch extending into the L-bar hinge component internal surface and which is contiguous with the L-bar hinge component torsion spring embedding groove; wherein the torsion spring second hook-shaped end is disposed within a U-bar hinge component embedding groove circumferentially disposed about the U-bar hinge component pivot pin hole and extending into the mating U-bar hinge component internal surface; wherein the torsion spring second hook-shaped end is embedded and retained in a U-bar hinge component torsion spring retainer notch extending into the U-bar hinge component internal surface and which is contiguous with the U-bar hinge component torsion spring embedding groove; and wherein each hinge assembly comprises a torsion spring tension setting means configured to vary tension of the torsion spring and to secure the torsion spring at two or more distinct tension settings without disassembly of the apparatus to provide two or more distinct desired levels of resistance to the relative rotation of each L-bar independently with respect to the U-bar, wherein the operation setting means comprise an operation setting pin having a proximal end and a distal end and an operation setting pin knob attached to the operation setting pin proximal end, wherein the operation setting pin is disposed within an operation setting pin hole extending through each U-bar hinge component parallel to the longitudinal axis of the pivot pin, and wherein the internal surface of each mating L-bar hinge component is configured to define an operation setting pin hole and an arc shaped operation setting pin slot positioned circumferentially about the pivot pin hole and proximate to the operation setting second pin hole; wherein both the operation setting pin holes and the arc shaped operation setting pin slots are dimensioned to accommodate the distal end of the operation setting pin, and wherein the arc shaped operation setting pin slot has an arc of about 90° and wherein each L-bar comprises a cylindrical roller circumferentially disposed about the L-bar distal section;

(b) adjusting the each torsion spring tension setting means to a select a desired level of resistance;

(c) attaining a starting position by sitting on a chair or bench with back erect, knees bent and feet flat on floor;

(d) positioning the exercise apparatus such that the U-bar median section maintains contact with the chest and the cylindrical rollers maintain contact on the thighs;

(e) bending at the waist with sufficient force provided by the abdominal muscles to overcome the level of resistance and move the U-bar median section downwardly towards the cylindrical rollers;

(f) returning to the starting position;

(g) lifting the left and right legs alternately, or in unison, with sufficient force provided by the thigh muscles to overcome the level of resistance.

11. A method for exercising leg muscles of a person comprising the steps of:

(a) providing the apparatus comprising: a U-bar with a first U-bar end section, a second U-bar end section and a U-bar median section; wherein the first U-bar end section, the second U-bar end section and the U-bar median section are essentially coplanar and wherein each of the U-bar end sections is perpendicular to the U-bar median section; wherein each U-bar end section comprises a U-bar hinge component having a U-bar hinge component internal surface and wherein each U-bar hinge component is configured to define a U-bar hinge component pivot pin hole extending therethrough; and two mirror-imaged L-bars each having an L-bar proximal end and an L-bar distal end, wherein each L-bar proximal end comprises an L-bar hinge component having an L-bar hinge component internal surface wherein each L-bar hinge component internal surface is mated to one of the corresponding U-bar hinge component internal surfaces and wherein each L-bar hinge component is configured to define an L-bar hinge component pivot pin hole extending therethrough; and two pivot pins each having a proximal end, a distal end and a longitudinal axis, wherein the distal end of one pivot pin extend through each of the U-bar pivot pin holes and the corresponding L-bar pivot pin hole to provide a first rotatable hinge assembly and a second rotatable hinge assembly such that each L-bar is independently rotatable with respect to the U-bar and wherein each L-bar proximal section rotates in a plane parallel to the plane of the first and second U-bar sections; wherein each rotatable hinge assembly comprises a torsion spring having a first hook-shaped end and a second hook-shaped end wherein the torsion spring first hook-shaped end is disposed within an L-bar hinge component torsion spring embedding groove circumferentially disposed about the L-bar pivot pin hole and extending into the L-bar hinge component internal surface and wherein the torsion spring first hook-shaped end is embedded and retained in an L-bar hinge component torsion spring retainer notch extending into the L-bar hinge component internal surface and which is contiguous with the L-bar hinge component torsion spring embedding groove; wherein the torsion spring second hook-shaped end is disposed within a U-bar hinge component embedding groove circumferentially disposed about the U-bar hinge component pivot pin hole and extending into the mating U-bar hinge component internal surface; wherein the torsion spring second hook-shaped end is embedded and retained in a U-bar hinge component torsion spring retainer notch extending into the U-bar hinge component internal surface and which is contiguous with the U-bar hinge component torsion spring embedding groove; and wherein each hinge assembly comprises a torsion spring tension setting means configured to vary tension of the torsion spring and to secure the torsion spring at two or more distinct tension settings without disassembly of the apparatus to provide two or more distinct desired levels of resistance to the relative rotation of each L-bar independently with respect to the U-bar, wherein the operation setting means comprise an operation setting pin having a proximal end and a distal end and an operation setting pin knob attached to the operation setting pin proximal end, wherein the operation setting pin is disposed within an operation setting pin hole extending through each U-bar hinge component parallel to the longitudinal axis of the pivot pin, and wherein the internal surface of each mating L-bar hinge component is configured to define an operation setting pin hole and an arc shaped operation setting pin slot positioned circumferentially about the pivot pin hole and proximate to the operation setting second pin hole; wherein both the operation setting pin holes and the arc shaped operation setting pin slots are dimensioned to accommodate the distal end of the operation setting pin, and wherein the arc shaped operation setting pin slot has an arc of about 90° and wherein each L-bar comprises a cylindrical roller circumferentially disposed about the L-bar distal section;

(b) positioning the U-bar against a flat surface;

(c) employing the operation setting means to adjust each L-bar to extend up from the flat surface at an approximate 90° angle;

(d) attaining a starting position by lying with the back against the flat surface with legs raised legs such that the U-bar median section is positioned at the buttocks and the legs extend over the L-bar distal ends such that the backs of the calves are in contact with the cylindrical rollers;

(e) moving the calves towards the buttocks such that the L-bar distal ends rotate towards the U-bar; and (f) moving the calves back to the starting position.

* * * * *